US011345498B2

(12) United States Patent
Cerati et al.

(10) Patent No.: US 11,345,498 B2
(45) Date of Patent: May 31, 2022

(54) CAPSULE MAKING MACHINE

(71) Applicant: AZIONARIA COSTRUZIONI MACCHINE AUTOMATICHE A.C.M.A. S.p.A., Bologna (IT)

(72) Inventors: Luca Cerati, Bologna (IT); Massimo Scrivani, Casteggio (IT); Eura Trivisonno, Castelmaggiore (IT); Ivan Eusepi, Castelmaggiore (IT)

(73) Assignee: AZIONARIA COSTRUZIONI MACCHINE AUTOMOTIVE S.P.A., Bologna (IT)

( * ) Notice: Subject to any disclaimer, the term of this patent is extended or adjusted under 35 U.S.C. 154(b) by 0 days.

(21) Appl. No.: 16/988,080

(22) Filed: Aug. 7, 2020

(65) Prior Publication Data

US 2020/0361647 A1 Nov. 19, 2020

Related U.S. Application Data

(62) Division of application No. 15/525,844, filed as application No. PCT/IB2015/059071 on Nov. 24, 2015, now Pat. No. 10,773,843.

(30) Foreign Application Priority Data

Nov. 26, 2014 (IT) ..... BO2014A000662

(51) Int. Cl.
*B65B 1/12* (2006.01)
*B65B 1/44* (2006.01)
(Continued)

(52) U.S. Cl.
CPC ..... *B65B 29/02* (2013.01); *B65B 1/12* (2013.01); *B65B 1/44* (2013.01); *B65B 1/46* (2013.01);
(Continued)

(58) Field of Classification Search
CPC ..... B65B 29/02; B65B 57/10; B65B 29/022; B65B 43/42; B65B 65/003; B65B 1/12; B65B 1/44; B65B 1/46
See application file for complete search history.

(56) References Cited

U.S. PATENT DOCUMENTS 5,371,996 A * 12/1994 Ueda ..... B65B 7/164 53/298
7,755,368 B2 7/2010 Herrmann et al.
(Continued)

FOREIGN PATENT DOCUMENTS

DE 3336752 A1 4/1985
DE 102012212033 A1 1/2014
(Continued)

OTHER PUBLICATIONS

European Search Report dated Oct. 23, 2019 from counterpart European App No. 19198023.4.
(Continued)

*Primary Examiner* — Marina A Tietjen
(74) *Attorney, Agent, or Firm* — Shuttleworth & Ingersoll, PLC; Timothy Klima

(57) ABSTRACT

A machine for making capsules of the type including a container and a dose of product inside the container, includes a feed system for feeding at least a first container along a feed path in a direction of feed; at least one filling station for supplying a dose of said product into said first container, at least one detecting station positioned along said feed path downstream of said filling station in the direction of feed and comprising a detecting sensor operating at said first seat configured to detect the moisture of the product supplied into the first container.

14 Claims, 2 Drawing Sheets

(51) Int. Cl.

| | |
|---|---|
| ***B65B 1/46*** | (2006.01) |
| ***B65B 29/02*** | (2006.01) |
| ***B65B 57/10*** | (2006.01) |
| ***B65B 43/42*** | (2006.01) |
| ***B65B 65/00*** | (2006.01) |

(52) U.S. Cl.
CPC ..... *B65B 29/022* (2017.08); *B65B 43/42* (2013.01); *B65B 57/10* (2013.01); *B65B 65/003* (2013.01)

(56) References Cited

U.S. PATENT DOCUMENTS

| | | | | |
|---|---|---|---|---|
| 8,330,473 | B2 | 12/2012 | Herrmann et al. | |
| 2004/0249591 | A1* | 12/2004 | Trebbi ..... | A61J 3/074 702/81 |
| 2008/0256908 | A1 | 10/2008 | Frabetti | |
| 2014/0352254 | A1* | 12/2014 | Rea ..... | B65B 29/02 53/167 |
| 2015/0204714 | A1 | 7/2015 | Boehringer | |

FOREIGN PATENT DOCUMENTS

| | | | | |
|---|---|---|---|---|
| EP | 2851303 | A1 | 3/2015 | |
| WO | 2013035061 | A2 | 3/2013 | |
| WO | WO-2013121319 | A1 * | 8/2013 | ..... B65B 29/022 |

OTHER PUBLICATIONS

TEWS: "Fuechtemessung mit der Mikrowellen-Resonanz-Technik"; TEWS Elekronik, Hamburg, Germany; Jun. 7, 2010 (with English translation).

International Seach Report and Written Opinion dated Mar. 18, 2016 for counterpart PCT App No. PCT/IB2015/059071.

* cited by examiner

CAPSULE MAKING MACHINE

This application is a divisional of U.S. patent application Ser. No. 15/525,844 filed May 10, 2017, which is the National Phase of International Application PCT/IB2015/059071 filed Nov. 24, 2015 which designated the U.S.

This application claims priority to Italian Patent Application No. B02014A000662 filed Nov. 26, 2014. All three application are incorporated by reference herein.

TECHNICAL FIELD

This invention relates to a capsule making machine and, more specifically, to a machine which makes capsules for infusion products.

BACKGROUND ART

Generally speaking, capsules for infusion products basically comprise a cup-like container, constituting the capsule proper, with or without a filter element inside it and having an inlet opening which is closed by a respective lid. A measured quantity of product—for example, coffee—is filled into the container in substantially known manner, in order to make a beverage by infusion of water through the capsule itself.

Machines for making capsules of this kind comprise a plurality of processing stations, including a station for filling, or dosing, the product into the container and a weighing station for checking that the container is correctly filled.

An example of a machine for making capsules for infusion products is described in patent application WO2013/035061.

In this machine, the capsules being processed are housed in respective seats made on brackets which feed the capsules along a predetermined path through the processing stations.

More specifically, in the filling station, the capsules—or rather, the containers—are made to pass under the filler, for example of the screw type, from which a certain quantity of product is allowed to drop.

Downstream of the filling station, along the feed path, in the weighing station, the filled capsules are extracted from the respective seat by means of a suitable lifting system in order to release them from the supporting bracket.

The weight of the capsules is then checked by means of loading cells built into the lifting system.

After being weighed, each capsule is lowered back into its seat on the bracket and fed to the subsequent stations.

Generally speaking, prior art capsule making machines comprise a feedback control system configured to control the filling station based on the weight values measured, that is to say, to control the filling of the capsules which follow those previously filled and weighed.

One disadvantage of prior art capsule making machines is due to the fact that a relatively long time is necessary to allow the product to settle inside the capsule after the capsule has been lifted and before it can be weighed.

Moreover, the lifting system must be free of the frame or base of the capsule making machine itself so that the vibrations and movements of the machine do not cause inaccurate measurements.

In practice, that means the lifting system and the loading cells constitute a self-contained unit separate from the machine frame and the architecture of the machine in its entirety is thus relatively complex and expensive.

In this context, the main technical purpose of this invention is to overcome the above mentioned disadvantages.

DISCLOSURE OF THE INVENTION

This invention has for an aim to provide a capsule making machine which is constructionally simpler than prior art solutions.

Another aim of the invention is to provide a capsule making machine in which the weighing system can be built into the structure of the machine itself.

The technical purpose and aims specified are substantially achieved by a packaging machine for making capsules according to the present disclosure.

BRIEF DESCRIPTION OF THE DRAWINGS

Further features of the invention and its advantages are more apparent in the non-limiting description below, with reference to a preferred but non-exclusive embodiment of an assembly station, as illustrated in the accompanying drawings, in which.

DETAILED DESCRIPTION OF PREFERRED EMBODIMENTS OF THE INVENTION

Figure 1:
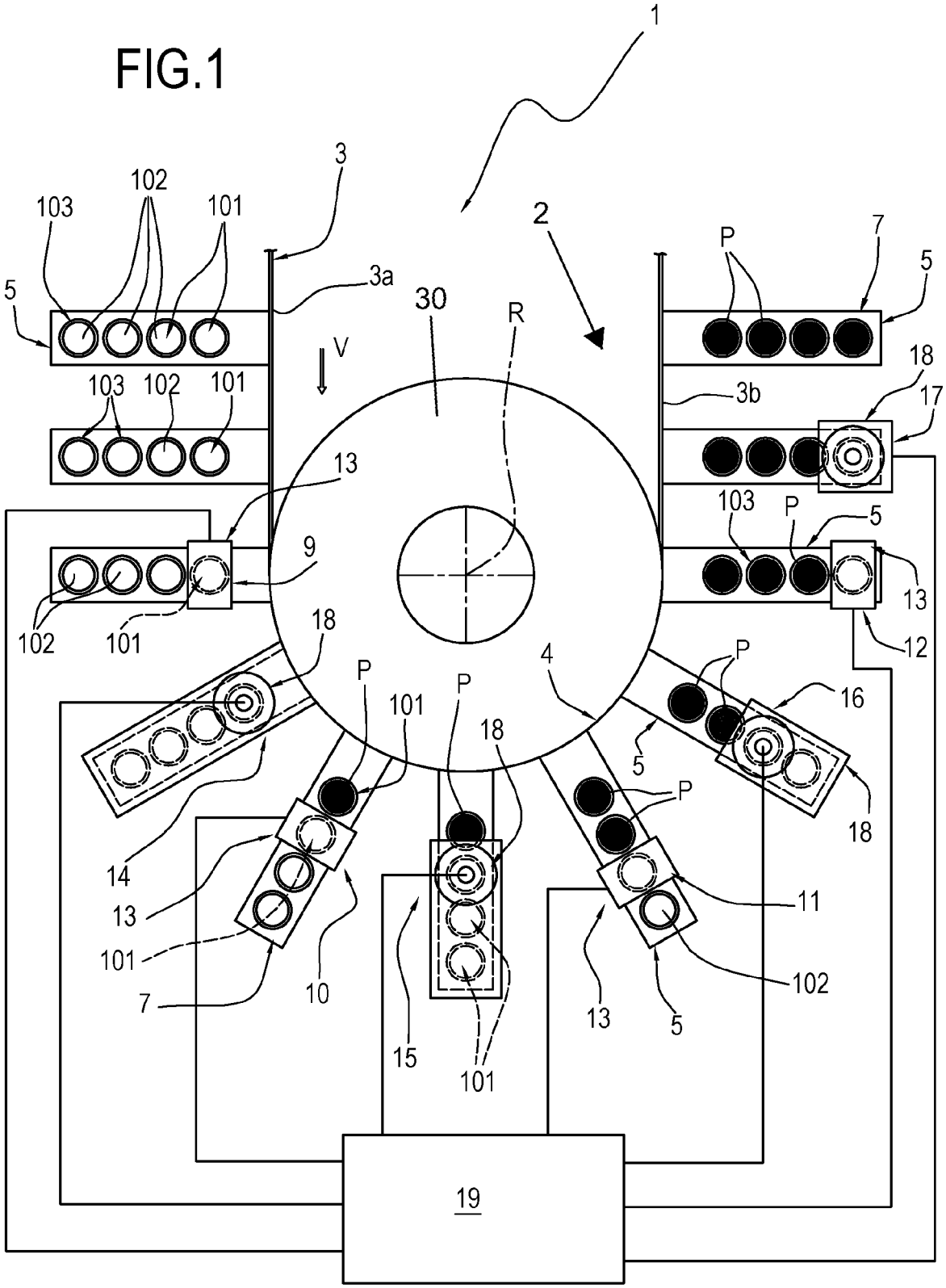
FIG. 1 illustrates a capsule making machine according to this invention in a schematic plan view, partly in blocks and with some parts cut away for greater clarity.

With reference to FIG. 1, the numeral 1 denotes a capsule making machine according to this invention.

The capsule making machine 1 is preferably designed to make capsules containing a granular product P for infusion.

A capsule basically comprises a substantially cup-like container 101—with or without one or more filtering elements, not illustrated, inside it—and a lid for closing the container 101.

The container 101 has an inlet opening 102 through which, as clarified further on in this description, the product P is supplied into the selfsame container 101 before the corresponding lid is applied.

The container 101 has an outer lip 103 surrounding the inlet opening 102 and intended, in particular, to be connected to the lid.

More specifically, a measured quantity of product—for example, coffee, to which explicit reference is hereinafter made but without thereby losing in generality—is filled into the container 101 in substantially known manner, in order to make a beverage by infusion of water through the capsule itself.

The machine 1, which is described only insofar as necessary for understanding this invention, comprises a feed system 2 for feeding the containers 101 along a feed path in a direction of feed V.

In the preferred embodiment illustrated, the system 2 comprises an endless belt 3 or the like, trained around at least one pulley, not illustrated, having an axis of rotation R directed into the plane of FIG. 1.

The feed path has a curved stretch 4, preferably substantially circular.

The belt 3 has an inside face 3*a* directed towards the axis of rotation R and an outside face 3*b* directed towards the side opposite the axis R.

The feed system 2 comprises a plurality of brackets 5 for supporting the containers 101.

Figure 2:
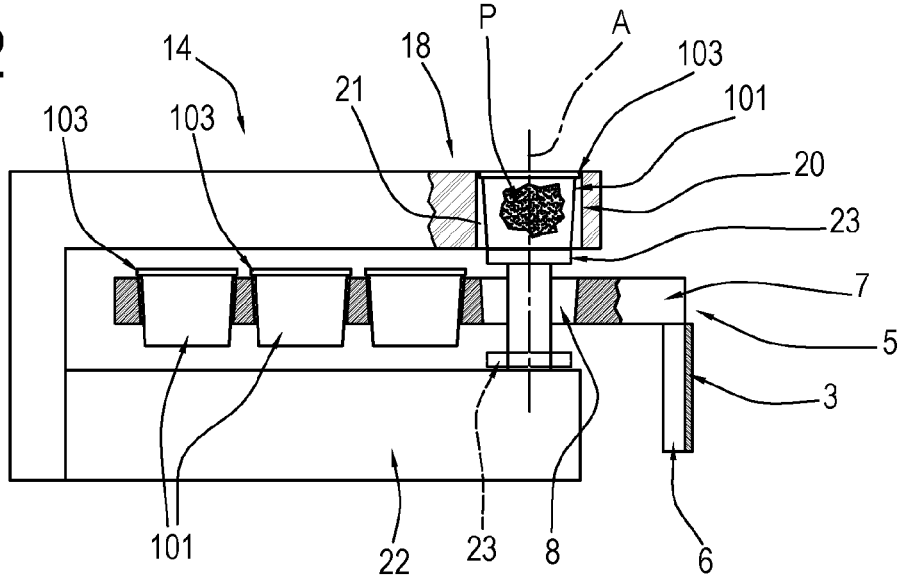
FIG. 2 illustrates a first embodiment of a processing station of the machine of FIG. 1, in a schematic front view, partly in blocks and with some parts cut away for greater clarity.
Figure 3:
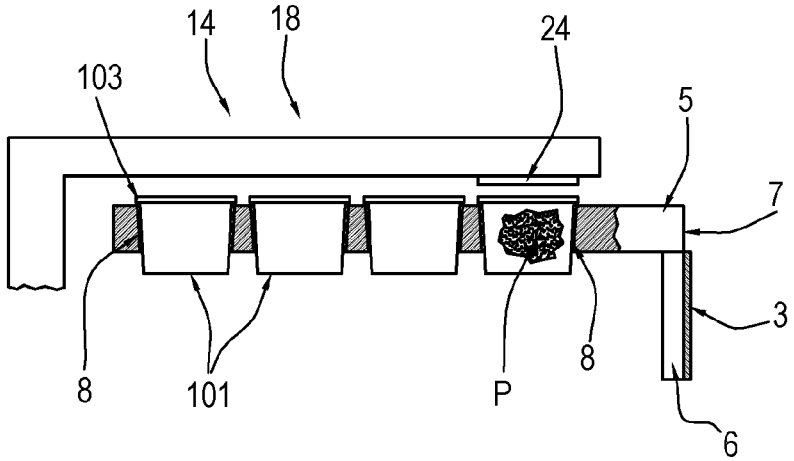
FIG. 3 illustrates a second embodiment of the processing station of FIG. 2, in a schematic front view, partly in blocks and with some parts cut away for greater clarity.

With particular reference to FIGS. 2 and 3, it may be observed that each bracket 5 comprises, for example, a first arm 6 connected to the face 3*b* of the belt 3 and extending, preferably, mainly in parallel with the axis R.

Each bracket 5 comprises a second arm 7 extending from the first arm 6, preferably at right angles thereto.

The second arm 7 has a plurality of seats 8—four in the example illustrated—each designed to receive and support a respective container 101.

The seats 8 preferably have a main axis "A" which is parallel to the axis R and are preferably in the form of through holes in the arm 7.

As illustrated, the container 101 is preferably inserted in known manner into the respective seat 8 and rests on the arm 7 by means of the lip 103.

In the example illustrated, the machine 2 comprises four filling stations 9, 10, 11, 12 for filling the containers 101 and positioned along the feed path.

Each station 9, 10, 11, 12 is designed to supply a dose of the product P into a corresponding container 101

Each station 9, 10, 11, 12 comprises a respective filler 13, for example of the screw type with vertical axis, to supply the dose of product P into the corresponding container 101.

In practice, only one container 101 is filled in each station 9, 10, 11, 12 and the number of filling stations preferably corresponds to the number of seats 8 made on each bracket 5.

In the preferred embodiment illustrated by way of example, the container 101 located in the seat 8 closest to the belt 3 is filled in the first station 9, and the containers 101 in the seats 8 located progressively further from the belt 3 are filled, respectively, in the stations 10, 11, 12 located downstream of the first station 9 in the direction of feed V.

The machine 1 comprises a plurality of detecting stations 14, 15, 16, 17—four in the example illustrated—positioned along the feed path.

Each detecting station 14, 15, 16, 17 is preferably located downstream of a respective filling station 9, 10, 11, 12 according to the direction of feed V, to detect a significant parameter of the dose of product P supplied into the respective container 101.

Each station 14, 15, 16, 17 comprises a respective detecting sensor 18, preferably a microwave sensor as described in more detail below, configured to detect the aforementioned parameter.

In practice, the parameter is detected in each station 14, 15, 16, 17 only in the container 101 filled in the filling station 9, 10, 11, 12 immediately upstream of the detecting station 14, 15, 16, 17 according to the direction of feed V.

Preferably, the number of detecting stations 14, 15, 16, 17 preferably corresponds to the number of seats 8 made on each bracket 5.

As mentioned, the detecting sensor 18 is a microwave sensor preferably configured to detect the moisture and/or density of the product P in each container 101.

More specifically, the microwaves are electromagnetic rays in the electromagnetic spectrum with wavelength between upper radio wave ranges and infrared rays.

The sensor 18 is composed of a microwave resonant zone characterized by a resonance peak frequency and a resonance bandwidth.

If a quantity of product P to be measured is placed in the resonant zone, the peak frequency and bandwidth shift, on first approximation, as a function of product mass, whereas their ratio to each other depends only on moisture.

It is thus possible to calculate the density and moisture of the product P based on the variation of the resonance curve.

Thus, knowing the value of the density of the product P and the volume of the container 101 containing the product P, it is possible to calculate the weight of the product P in each container 101.

Advantageously, in each station 14, 15, 16, 17, the detecting sensor 18 operates at the seat 8 previously filled in the filling station 9, 10, 11, 12 immediately upstream of the detecting station 14, 15, 16, 17 according to the direction of feed V.

The machine 1 comprises a control unit, schematically represented as a block 19, in communication with the sensors 18.

The unit 19 is configured to process the parameter, and more specifically, the moisture and/or density of the product P, detected by each sensor 18, and to provide a piece of information about the weight of each dose of product P supplied into the corresponding container.

In practice, in a substantially known manner, the unit 19 provides, for each container 101, an indication of the weight of the product P dosed into the container 101.

Advantageously, the unit 19 is in communication with the fillers 13 in the filling stations 9, 10, 11, 12 and is configured to drive each filler 13 as a function of the weight calculated.

The unit 19 controls the filling stations 9, 10, 11, 12 based on the quantity of product actually supplied into the respective container 101.

With particular reference to FIG. 2, which is a detail showing a first embodiment of the station 14, the detecting sensor 18 comprises a cylindrical resonator 20 of substantially known type.

As illustrated, the resonator 20 is mounted above the bracket 5, in particular above the arm 7.

The resonator 20 has a cavity 21 having a respective inlet opening.

The resonator 20 is mounted in such a way that the cavity 21, and more specifically, the inlet opening thereof, is opposite the seat 8 of the container 101 to be checked, that is to say, looking at FIG. 2, the inlet opening of the cavity 21 is directed downwards.

In each station 14, 15, 16, 17, the corresponding cylindrical resonator 20 is opposite a respective seat 8 housing the container 101 to be checked.

The detecting station 14 comprises a lifting device 22 located on the opposite side of the resonator 20 relative to the arm 7.

The device 22 comprises a piston 23 which is movable, in a substantially known manner, between a lowered position, illustrated by the dashed line in FIG. 2, and a raised position.

The piston 23 is movable along the axis A of the corresponding seat 8 in such manner as to pass through the latter.

The piston 23 is configured to transfer the container 101, at least partly, from the seat 8 into the cavity 21, passing from the lowered to the raised position and, vice versa, from the raised to the lowered position.

Advantageously, in order to measure at least the moisture from which, as mentioned, the unit 19 calculates the weight of the product P dosed into the container 101, the microwave sensor 18 can operate even without waiting for the product to settle after lifting.

With reference to FIG. 3, which is a detail showing the station 14 in a second embodiment of it by way of example, the detecting sensor 18 comprises a flat resonator 24 of substantially known type.

The resonator 24 is opposite the seat 8 in such a way as to be opposite the product P inside the container 101 so as to scan it with the microwaves to measure the moisture and/or density of the product P to be transmitted to the unit 19.

In order not to interfere with the resonator 24, the bracket 5 is made preferably of a plastic or ceramic material, preferably of the low loss type, such as, for example PEEK or HDPE.

Figure 4:
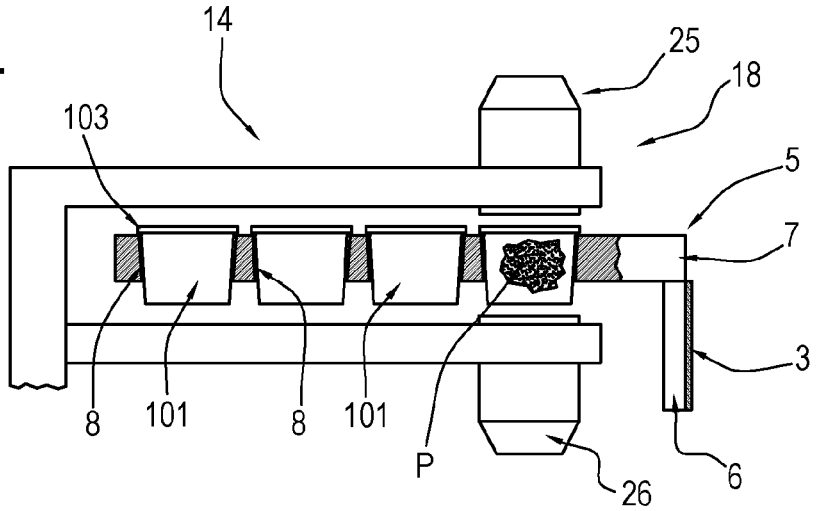
FIG. 4 illustrates a third embodiment of the processing station of FIG. 2, in a schematic front view, partly in blocks and with some parts cut away for greater clarity.

With reference to FIG. 4, which is a detail showing the station 14 in a third embodiment of it by way of example, the detecting sensor 18 comprises a resonator of the type known as "fork resonator" of substantially known type, comprising a microwave emitter 25 and a corresponding receiver 26.

The emitter 25 and the receiver 26 are mounted on opposite sides of the arm 7 so that the microwaves transmitted between them pass through the corresponding seat 8 and the container 101 housed therein.

Thus, the product P inside the container 101 can be scanned with the microwaves to measure the moisture and/or density of the product P to be transmitted to the unit 19.

In order not to interfere with the emitter 25 and receiver 26, the bracket 5 is made preferably of a plastic or ceramic material, preferably of the low loss type, such as, for example PEEK or HDPE.

Generally speaking, the microwave device allows detecting the density of the product in the capsule and, knowing the volume of the capsule, also the weight of the product inside.

More specifically, a microwave device allows measuring in known manner the moisture of a product, which can then be correlated with the density.

The detecting stations which allow measuring the weight of the product in the containers using microwave sensors can be integrated in and mounted on the same frame as that of all the other machine stations.

It should be noted that there can be more than one sensor 18 for each measurement to be performed, so that the data detected can be crossed and a more precise result obtained. In particular, the sensors 18 can be in the same detecting station. Alternatively, the sensors 18 can be located in successive detecting stations.

It should be noted that using at least one sensor 18 makes it possible to recognize the weight of two or more products inside the same container. This is advantageous when a container, for example, contains a layer of coffee and layer of powdered milk and a parameter of each needs to be detected. The weights of the two distinct products can thus be obtained.

It should also be noted that a further sensor 18 might also be provided before the filling station in order to take a measurement of the container when it is still empty, so as to obtain the tare weight.

The architecture of the machine is thus simpler than that of the prior art solutions and the quantity of product dosed into the containers can be properly checked and adjusted.

The invention claimed is:

1. A machine for making capsules, where the capsules each include a container and a dose of product inserted in the container, wherein the container is cup-shaped having an inlet opening, through which the product is supplied into the container before a corresponding lid is applied, and an outer lip surrounding the inlet opening, said machine comprising:

a feed system for feeding at least a container along a feed path in a direction of feed, said feed system comprising a seat for said container, said machine comprising;

a filling station positioned along the feed path and comprising at least one filling unit for supplying the dose of product into said container, a detecting station positioned along said feed path downstream of said filling station according to said direction of feed and comprising a detecting sensor operating at said seat, said detecting sensor configured to detect a first parameter of said dose of product supplied into said container, wherein said detecting sensor is a microwave sensor and said first parameter is the moisture or the density of the dose of product supplied into said first container, a control unit in communication with the microwave sensor, the control unit being provided with a volume of the container and being configured to process said first parameter detected by the microwave sensor and to calculate a weight of the dose of the product supplied into the container based on said first parameter and the volume of the container.

2. The machine according claim 1, wherein said feed system comprises a bracket comprising said seat.

3. The machine according to claim 2, wherein said microwave sensor comprises a fork resonator comprising a microwave emitter and a microwave receiver, said microwave emitter and said microwave receiver being positioned on opposite sides of said bracket at the seat in the detecting station such that microwaves transmitted by the microwave emitter towards the microwave receiver pass through the dose of product in said container housed in said seat.

4. The machine according to claim 2, wherein the feed system comprises an endless belt having an inside face and an outside face, the bracket comprising a first arm connected to the outside face of the belt and a second arm extending from the first arm, the seat being provided in the second arm.

5. The machine according to claim 4 wherein the seat is configured as a through hole in the second arm.

6. The machine according to claim 4, wherein the container is inserted into said seat and rests on the second arm by lip.

7. The machine according to claim 2, and further comprising a plurality of the filling stations and a plurality of the seats on the bracket, and wherein a quantity of the filling stations corresponds to a quantity of the seats on the bracket.

8. The machine according to claim 2, and further comprising a plurality of the detecting stations and a plurality of the seats on the bracket, and wherein a quantity of the detecting stations corresponds to a quantity of the seats on the bracket.

9. The machine according to claim 1 comprising a plurality of the detecting stations and a plurality of the filling stations positioned along the feed path, and a plurality of the microwave sensors, each of the detecting stations being located downstream of a respective one of the filling stations according to the direction of feed to detect said first parameter supplied into the respective container, each of the detecting stations comprising a respective one of the microwave sensors, the first parameter being detected in each detecting station only in the container filled in the respective one of the filling stations immediately upstream of the respective one of the detecting stations according to the direction of feed.

10. The machine according to claim 1, wherein said control unit is in communication with said filling unit and is configured to control said filling unit as a function of the weight of said dose.

11. The machine according to claim 1, wherein said detecting sensor comprises a flat resonator.

12. The machine according to claim 1, wherein said detecting sensor comprises a cylindrical resonator.

13. The machine according to claim 1, wherein said feed system comprises a bracket comprising said seat, wherein said microwave sensor comprises a fork resonator comprising a microwave emitter and a microwave receiver, said microwave emitter and said microwave receiver being positioned on opposite sides of said bracket at the seat in the detecting station such that microwaves transmitted by the microwave emitter towards the microwave receiver pass through the dose of product in said container housed in said seat, wherein the bracket is made of a plastic or ceramic material.

14. The machine according to claim 1, and further comprising a frame, wherein the filling station and the detecting station are both mounted to the frame.

* * * * *